US006659745B2

(12) United States Patent
Fujita et al.

(10) Patent No.: US 6,659,745 B2
(45) Date of Patent: Dec. 9, 2003

(54) SCROLL COMPRESSOR HAVING DIFFERENT TIP CLEARANCES FOR SPIRAL BODIES HAVING DIFFERENT HEIGHTS

(75) Inventors: Katsuhiro Fujita, Nishi-kasugai-gun (JP); Makoto Takeuchi, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/198,992

(22) Filed: Jul. 22, 2002

(65) Prior Publication Data

US 2003/0021712 A1 Jan. 30, 2003

(30) Foreign Application Priority Data

Jul. 24, 2001 (JP) ..... 2001-222736

(51) Int. Cl.[7] ..... F04C 18/04
(52) U.S. Cl. ..... 418/55.2; 418/55.4
(58) Field of Search ..... 418/5, 55.2, 55.4

(56) References Cited

U.S. PATENT DOCUMENTS

| | | | | |
|---|---|---|---|---|
| 4,457,674 A | | 7/1984 | Kawano et al. | 418/5 |
| 4,472,120 A | * | 9/1984 | McCullough | 418/55.2 |
| 4,477,238 A | * | 10/1984 | Terauchi | 418/55.2 |
| 4,701,115 A | | 10/1987 | Shimizu et al. | 418/55.4 |
| 4,722,676 A | | 2/1988 | Sugimoto | 418/55.4 |
| 5,505,595 A | | 4/1996 | Fukui | 418/55.1 |
| 5,545,020 A | | 8/1996 | Fukanuma et al. | 418/55.4 |
| 5,569,028 A | | 10/1996 | Yamamura et al. | 418/55.4 |

FOREIGN PATENT DOCUMENTS

| | | | |
|---|---|---|---|
| JP | 59-176483 | * 10/1884 | 418/55.2 |
| JP | 60-17956 | 5/1985 | |
| JP | 61-8404 | 1/1986 | |
| JP | 4-121483 | 4/1992 | |
| JP | 4-311693 | 11/1992 | |
| JP | 8-28461 | 1/1996 | |
| JP | 9-112456 | 5/1997 | |

* cited by examiner

*Primary Examiner*—John J. Vrablik
(74) *Attorney, Agent, or Firm*—Oblon, Spivak, McClelland, Maier & Neustadt, P.C.

(57) ABSTRACT

An object of the present invention is to provide a scroll compressor which can improve the decrease in the compression ratio due to the leakage of compressed gas via a tip clearance between adjacent compression chambers, which can be assembled with fewer processes, and which can be manufactured at a low cost. In order to achieve the object, the present invention provides: a scroll compressor comprising a fixed scroll member which is fixed in position and has a spiral wall body provided on one surface of an end plate; an orbiting scroll member which has a spiral wall body provided on one surface of an end plate, being supported by engaging the spiral wall bodies so as to orbit and revolve around the fixed scroll member without rotation; the spiral wall bodies of the fixed scroll member and the orbiting scroll member each comprise a step portion which divides a top edge of the spiral wall body into plural parts forming a low top edge at the center and a high top edge at the outer end of the spiral wall body; and the end plates of the fixed scroll member and the orbiting scroll member each comprise a step portion which divides the end plate into a high part at the center and a low part at the outer end of the end plate; wherein at least one of a clearance between the high part of the end plate of the fixed scroll member and the low top edge of the spiral wall body of the orbiting scroll member, and a clearance between the high part of the end plate of the orbiting scroll member and the low top edge of the spiral wall body of the fixed scroll member is a fixed value.

3 Claims, 5 Drawing Sheets

PRIOR ART

PRIOR ART

SCROLL COMPRESSOR HAVING DIFFERENT TIP CLEARANCES FOR SPIRAL BODIES HAVING DIFFERENT HEIGHTS

BACKGROUND OF THE INVENTION

1. Field of the Invention

The present invention relates to a scroll compressor which is installed in an air conditioner, a refrigerator, or the like, and in particular, a scroll compressor comprising characteristic scroll members.

2. Description of the Related Art

In conventional scroll compressors, a fixed scroll and an orbiting scroll are provided by engaging their spiral wall bodies, and fluid inside a compression chamber, which has a crescent shape and is formed between the spiral wall bodies, is compressed by gradually reducing the volume of the compression chamber as the orbiting scroll revolves around the fixed scroll.

The compression ratio in the design of the scroll compressor is determined based on the ratio of the maximum volume of the compression chamber (the volume at the point when the compression chamber is formed by the engaging of the spiral wall bodies) with respect to the minimum volume of the compression chamber (the volume immediately before the spiral wall bodies become unengaged and the compression chamber disappears). Conventionally, in order to increase the compression ability of the scroll compressor, the number of windings of the spiral wall bodies of both scrolls is increased, and thereby the cross-sectional area of the compression chamber at maximum volume is increased. However, in the conventional method of increasing the number of windings of the spiral wall bodies, the external shape of the scrolls is enlarged, increasing the size of the compressor; for this reason, it is difficult to use this method in an air conditioner for vehicles and the like which have strict size limitations.

In an attempt to solve the problem, the publication of Japanese Patent No. 1296431 proposes the following scroll compressor comprising stepwise scroll members.

FIG. 4A shows a fixed scroll 1 of the above patent comprising an end plate 1*a* and a spiral wall body 1*b* provided on one side surface of the end plate 1*a*. FIG. 4B shows an orbiting scroll 2 similarly comprising an end plate 2*a* and a spiral wall body 2*b* provided on one side surface of the end plate 2*a*.

A step portion 3 is provided on the surface of the end plate 1*a* of the fixed scroll 1. The step portion 3 has two parts in which one is a high part at the center of the surface of the end plate 1*a* and the other is a low part at the outer end of the end plate 1*a*. Furthermore, a step portion 4, corresponding to the step portion 3 of the end plate 1*a*, is provided in the spiral wall body 1*b* of the fixed scroll 1. The step portion 4 has two parts in which one is a low part at the center of the spiral wall body 1*b* and the other is a high part at the outer end of the spiral wall body 1*b*. Similarly, a step portion 3 is provided on the surface of the end plate 2*a* of the orbiting scroll 2. The step portion 3 has two parts in which one is a high part at the center of the surface of the end plate 2*a* and the other is a low part at the outer end of the end plate 2*a*. Furthermore, a step portion 4, corresponding to the step portion 3, is provided in the spiral wall body 2*b* of the orbiting scroll 2. The step portion 4 has two parts in which one is a low part at the center of the spiral wall body 2*b* and the other is a high part at the outer end of the spiral wall body 2*b*.

FIG. 5 shows the state when the spiral wall body 1*b* of the fixed scroll 1 and the spiral wall body 2*b* of the orbiting scroll 2 are engaged. While this engagement state is maintained, the orbiting scroll 2 is revolved eccentrically with respect to the fixed scroll 1, and the volume of compression chambers C1 to C5, which are formed by the spiral wall bodies 1*b* and 2*b*, gradually decreases. Thereby, fluid in the compression chambers C1 to C5 is gradually compressed, and finally the fluid is discharged at a high pressure from a discharge port 5 provided at the center of the end plate 1*a* of the fixed scroll 1. In the scroll compressor comprising such a structure, since the volume of the compression chamber suddenly decreases because of the existence of the step portions 3 and 3, the minimum volume in the compression chambers can be reduced. Thereby, without an increase in the size of both the fixed scroll 1 and the orbiting scroll 2, the compression ratio can be improved.

However, in the scroll compressor comprising the fixed scroll 1 and the orbiting scroll 2 comprising the step portions 3 and 3, a tip clearance (not shown in figures) is formed between the end plate 1*a* of the fixed scroll 1 and the top edge of the spiral wall body 2*b* of the orbiting scroll 2, and between the end plate 2*a* of the orbiting scroll 2 and the top edge of the spiral wall body 1*b* of the fixed scroll 1. If the tip clearance is too small, the smooth revolution of the orbiting scroll 2 with respect to the fixed scroll 1 is inhibited, and a power increase may be caused. In addition, when the scroll compressor is operated at high temperatures, the spiral wall bodies 1*b* and 2*b* of the fixed scroll 1 and the orbiting scroll 2 expand, the top edge of the spiral wall bodies 1*b* and 2*b* and the end plates 1*a* and 2*a* make firmly contact, and thereby, abrasion or seizure may occur.

Furthermore, as described above, since the volume of the compression chambers suddenly decreases due to the existence of the step portions 3 and 3, the differential pressure between in the compression chambers at the center and the compression chambers at the outer end, with respect to the step portions 3 and 3 is relatively large.

In contrast, if the tip clearance is too large, the amount of leakage of the compressed gas, which flows via the tip clearance between the adjacent compression chambers increases, and there are cases in which the compression ability of the scroll compressor is degraded.

Therefore, it is necessary for the tip clearance to be adjusted in a suitable range. In conventional scroll compressors, a tip clearance at any position in the spiral direction of the spiral wall bodies 1*b* and 2*b* is adjusted to a substantially fixed value. In other words, if the tip clearance between the end plates 1*a* and 2*a* and the top edge of the spiral wall bodies 1*b* and 2*b* at the low part of the end plates 1*a* and 2*a* (outer end of the end plates 1*a* and 2*a* with respect to the step portions 3 and 3) is defined as $\delta 1$, and the tip clearance between the end plates 1*a* and 2*a* and the top edge of the spiral wall bodies 1*b* and 2*b* at the high part of the end plates 1*a* and 2*a* (center position of the end plates 1*a* and 2*a* with respect to the step portions 3 and 3) is defined as $\delta 2$, in conventional scroll compressors, the relation $\delta 1=\delta 2$ is established.

However, in order to satisfy the relation $\delta 1=\delta 2$, it is necessary to improve the working precision of the fixed scroll 1 and the orbiting scroll 2, and measure $\delta 1$ and $\delta 2$ during the assembly processes. A large number of man-hours is required, and an increase in the cost cannot be avoided.

In consideration of the above-described problems, it is an object of the present invention to provide a scroll compressor which can improve the decrease in the compression ratio due to the leakage of compressed gas via the tip clearance between the adjacent compression chambers, which can be assembled with a fewer processes, and which can be manufactured at a low cost.

SUMMARY OF THE INVENTION

One aspect of the present invention is a scroll compressor comprising a fixed scroll member which is fixed in position and has a spiral wall body provided on one surface of an end plate; an orbiting scroll member which has a spiral wall body provided on one surface of an end plate, being supported by engaging the spiral wall bodies so as to orbit and revolve around the fixed scroll member without rotation; the spiral wall bodies of the fixed scroll member and the orbiting scroll member each comprise a step portion which divides a top edge of the spiral wall body into plural parts forming a low top edge at the center and a high top edge at the outer end of the spiral wall body; and the end plates of the fixed scroll member and the orbiting scroll member each comprise a step portion which divides the end plate into a high part at the center and a low part at the outer end of the end plate; wherein at least one of a clearance between the high part of the end plate of the fixed scroll member and the low top edge of the spiral wall body of the orbiting scroll member, and a clearance between the high part of the end plate of the orbiting scroll member and the low top edge of the spiral wall body of the fixed scroll member is a fixed value.

According to this scroll compressor, since the scroll compressor is assembled only by adjusting a clearance $\delta 2$ between the high part of the end plate and low top edge of the spiral wall body to a fixed value, the working of the fixed scroll member and the orbiting scroll member is easy and the assembly of the scroll compressor is relatively easy.

In the scroll compressor, when the tip clearance between the low part of the end plates and the high top edge of the spiral wall bodies corresponding to the low part is defined as $\delta 1$, and the tip clearance between the high part of the end plates and the low top edge of the spiral wall bodies corresponding to the high part of the end plates is defined as $\delta 2$, it is preferable to establish the relation $\delta 1<\delta 2$.

Here, the tip clearances $\delta 1$ and $\delta 2$ during operation are defined as $\delta 1d$ and $\delta 2d$. As described above, during operation, the volume of the compression chambers at the center with respect to the step portion suddenly decreases, and the pressure of the compression chambers suddenly increases. Therefore, in the temperature distribution of the scroll members, the temperature at the center of the scroll members is higher than that at the outer end of the scroll members.

In other words, due to expansion by heat of the scroll members, the tip clearance $\delta 2d$ at the high temperature side during operation, that is, the tip clearance $\delta 2d$ at the center of the scroll members during operation, is smaller than the tip clearance $\delta 2$ which is determined in the assembly process.

In contrast, since the tip clearance $\delta 1d$ at the outer end of the scroll members during operation does not decrease as compared with the tip clearance $\delta 2d$ at the center of the scroll members, the tip clearances $\delta 1d$ and $\delta 2d$ during operation level off, and an excellent performance for scroll compressors can be obtained. That is, it is possible to prevent the leakage of the compressed gas and to improve the refrigeration ability.

In addition, in the scroll compressor, it is preferable for a groove to be formed on the top edge of the spiral wall bodies, for a tip seal for sealing the border between the top edge of the spiral wall bodies and the end plates which are opposite the spiral wall bodies to be fit into the groove, and for at least one of a tip seal which is fit into the groove on the high top edge of the spiral wall body of the orbiting scroll member corresponding to the low part of the end plate of the fixed scroll member, and another tip seal which is fit into the groove on the high top edge of the spiral wall body of the fixed scroll member corresponding to the low part of the end plate of the orbiting scroll member, protrudes from the high top edge of the spiral body.

According to the scroll compressor, a tip seal for sealing the border between the top edge of the spiral wall bodies and the end plates which are opposite the spiral wall bodies is provided on the top edge of the spiral wall bodies so as to protrude from the top edge of the spiral wall bodies. In general, the high pressure compressed gas near the center of the spiral wall bodies enters between the tip seal and the inside surface of the groove and reaches the gap between the bottom surface of the tip seal and the bottom surface of the groove. Then, the compressed gas applies a back pressure to the bottom surface of the tip seal and thereby the tip seal is pressed upward. Then, the tip seal provided in the top edge of the spiral wall body contacts the end plate, and it seals the border between the top edge of the spiral wall body and the end plate. In the scroll compressor comprising stepwise spiral wall bodies, for example, the tip seal provided in the spiral wall body of the fixed scroll member is divided into two parts in which one is provided at the center and the other is provided at the outer end of the spiral wall body, with respect to the step portion. Since, the pressure of the working gas in the compression chamber at the outer end of the spiral wall body is lower compared with the pressure of the working gas in the compression chamber at the center of the spiral wall body, the back pressure applied to the tip seal which is provided at the outer end of the spiral wall body is also lower than that applied to the tip seal which is provided at the center of the spiral wall body. Therefore, the seal ability is improved by making the tip seal protrude from the high top edge at the outer end of the spiral wall body in advance, and the refrigerating ability of the scroll compressor is improved.

BRIEF DESCRIPTION OF THE DRAWINGS

FIG. 3 shows a fixed end plate of the fixed scroll of FIG. 1 and a top edge of a spiral wall body of the orbiting scroll of FIG. 1.

DETAILED DESCRIPTION OF THE INVENTION

An embodiment of the scroll compressor according to the present invention will be explained with reference to the figures. However, of course, the scroll compressor of the present invention is not limited to the following embodiments.

First Embodiment

Figure 1:
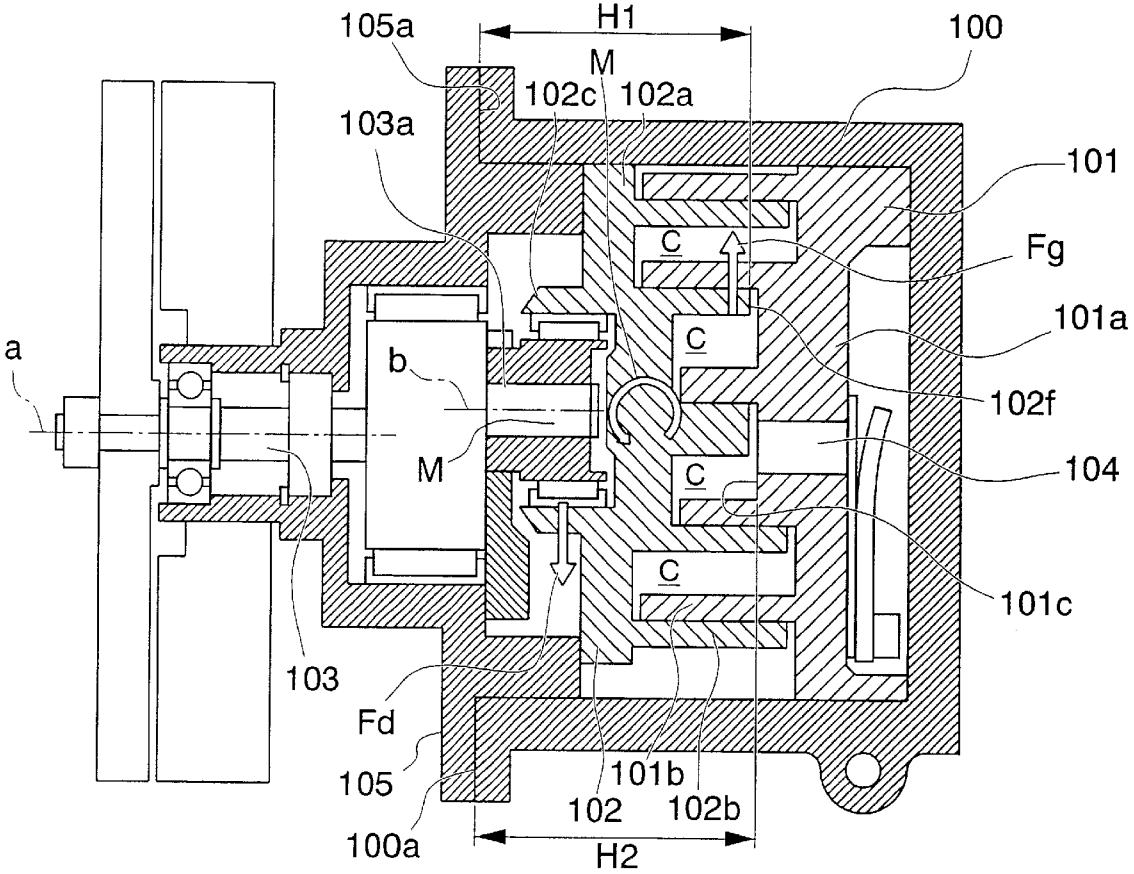
FIG. 1 is a side cross-sectional view of an embodiment of the scroll compressor according to the present invention.

As shown in FIG. 1, the scroll compressor of this embodiment comprises a housing 100, a fixed scroll member 101 fixed in the housing 100, an orbiting scroll member 102 provided in the housing 100 so as to revolve with respect to the fixed scroll 101, a front case (cover) 105 fixed to the open end of the housing 100, which prevents the orbiting scroll member 102 from moving as a result of the thrust generated by the revolution of the orbiting scroll member 102, and a shaft 103 for revolving the orbiting scroll member 102.

In the shaft 103, a crank pin 103*a*, of which axis b is eccentric with respect to axis a of the shaft 103, is provided. The crank pin 103*a* is inserted in and indirectly connected with a boss 102*c* which is provided at the center of the orbiting scroll member 102.

The fixed scroll member 101 comprises a fixed end plate (end plate) 101*a* and a spiral wall body 101*b* provided on one surface of the fixed end plate 101*a*. Similarly, the orbiting scroll member 102 comprises an orbiting end plate (end plate) 102*a* and a spiral wall body 102*b* provided on one surface of the orbiting end plate 102*a*.

In addition, on the surface of the fixed end plate 101*a* of the fixed scroll member 101, on which the spiral wall body 101*b* is provided, a step portion is provided comprising two parts in which one is a high part at the center of the surface of the fixed end plate 101*a* and the other is a low part at the outer end of the surface of the fixed end plate 101*a*. Similarly, on the surface of the orbiting end plate 102*a* of the orbiting scroll member 102, on which the spiral wall body 102*b* is provided, a step portion is provided comprising two parts in which one is a high part at the center of the surface of the orbiting end plate 102*a* and the other is a low part at the outer end of the surface of the orbiting end plate 102*a*. Moreover, the step portions, which are provided on the surfaces of the fixed end plate 101*a* and the orbiting end plate 102*a*, are omitted in FIG. 1.

Figure 2:
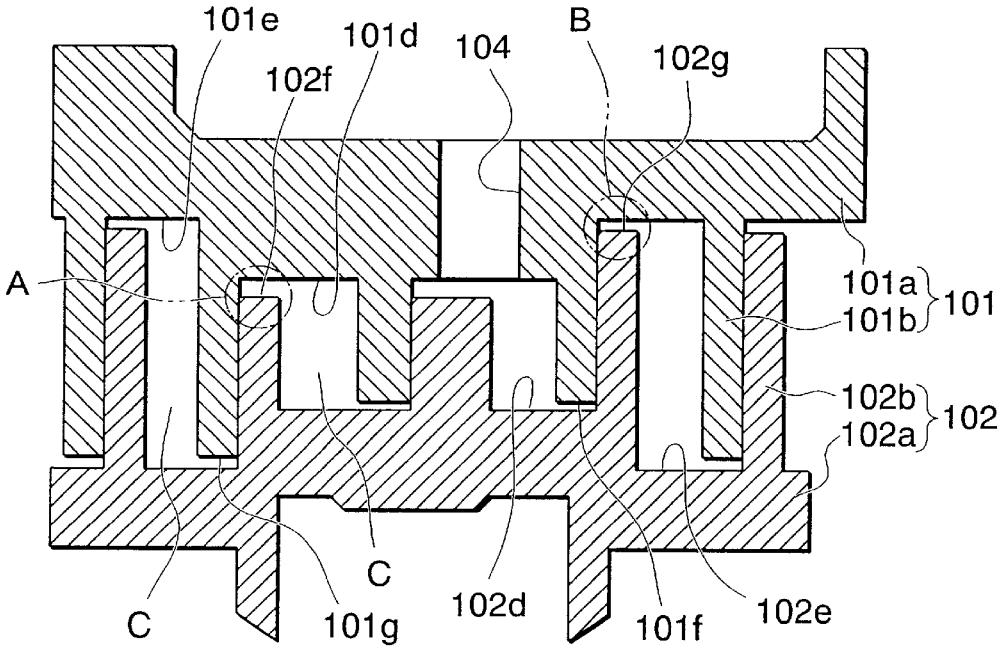
FIG. 2 is a cross-sectional view showing the state in which the fixed scroll and the orbiting scroll of FIG. 1 are engaged.

This structure will be explained in detail with reference to FIG. 2. As shown in FIG. 2, the fixed end plate 101*a* of the fixed scroll 101 comprises two parts in which one is a high part 101*d* at the center of the surface of the end plate 101*a* and the other is a low part 101*e* at the outer end of the surface of the end plate 101*a*, with respect to the step portion. Similarly, the orbiting end plate 102*a* of the orbiting scroll 102 comprises two parts in which one is a high part 102*d* at the center of the surface of the surface of the end plate 102*a* and the other is a low part 102*e* at the outer end of the surface of the end plate 102*a*, with respect to the step portion.

Furthermore, the spiral wall body 101*b* of the fixed scroll member 101 comprises two parts, corresponding to the step portion of the orbiting end plate 102*a*. That is, the spiral wall body 101*b* comprises two parts in which one is a low part at the center thereof and the other is a high part at the outer end thereof. Similarly, the spiral wall body 102*b* of the orbiting scroll member 102 comprises two parts, corresponding to the step portion of the fixed end plate 101*a*. That is, the spiral wall body 102*b* comprises two parts in which one is a low part at the center thereof and the other is a high part at the outer end thereof.

The structure of the spiral wall bodies 101*b* and 102*b* will be explained in detail with reference to FIG. 2. The top edge of the spiral wall body 101*b* of the fixed scroll member 101 comprises two parts in which one is a low top edge 101*f* and the other is a high top edge 101*g*. The low top edge 101*f* is the top edge of the low part of the spiral wall body 101*b*, which is provided at the center of the spiral wall body 101*b*. The high top edge 101*g* is the top edge of the high part of the spiral wall body 101*b*, which is provided at the outer end of the spiral wall body 101*b*. A connecting edge of a step portion stands perpendicular to the surface of the spiral wall body 101*b* and connects between the adjacent low top edge 101*f* and high top edge 101*g*. Similarly, the top edge of the spiral wall body 102*b* of the orbiting scroll member 102 comprises two parts in which one is a low top edge 102*f* and the other is a high top edge 102*g*. The low top edge 102*f* is the top edge of the low part of the spiral wall body 102*b*, which is provided at the center of the spiral wall body 102*b*. The high top edge 102*g* is the top edge of the high part of the spiral wall body 102*b*, which is provided at the outer end of the spiral wall body 102*b*. A connecting edge of a step portion stands perpendicular to the surface of the spiral wall body 102*b* and connects between the adjacent low top edge 102*f* and high top edge 102*g*.

When the orbiting scroll member 102 is engaged with the fixed scroll member 101, the low top edge 102*f* of the spiral wall body 102*b* contacts the high part 101*d* of the fixed end plate 101*a*, and the high top edge 102*g* of the spiral wall body 102*b* contacts the low part 101*e* of the fixed end plate 101*a*. Simultaneously, the high top edge 101*g* of the spiral wall body 101*b* contacts the low part 102*e* of the orbiting end plate 102*a*, and the low top edge 101*f* of the spiral wall body 101*b* contacts the high part 102*d* of the orbiting end plate 102*a*. Thereby, between the fixed scroll member 101 and the orbiting scroll member 102, a plurality of compression chambers C are formed, which are enclosed by the fixed and orbiting end plates 101*a* and 102*a*, which are opposite each other, and the spiral wall bodies 101*b* and 102*b*.

When the orbiting scroll member 102 revolves with respect to the fixed scroll member 101 by the rotation of the shaft 103, each of the compression chambers C moves from the outer end toward the center, as the orbiting scroll 102 revolves. The gas in the compression chambers C is gradually compressed by the gradual decrease of the volume of the compression chambers C, and finally the gas is discharged from a discharge port 104 provided at the center of the fixed end plate 101*a*.

In the scroll compressor, a tip clearance (not shown in figures) for maintaining the smooth revolution of the orbiting scroll member 102 with respect to the fixed scroll member 101 is formed between the fixed end plate 101*a* and the spiral wall body 102*b*, and between the orbiting end plate 102*a* and the spiral wall body 101*b*. In the scroll compressor of this embodiment, the tip clearance is adjusted by a distinctive method. In addition, the tip clearance of the scroll compressor of this embodiment has a distinctive size.

Below, an assembly method of the scroll compressor of this embodiment will be explained with reference to FIG. 1. The housing 100 and the fixed scroll member 101 have already been fixed by a bolt (not shown in FIG. 1). While this state is maintained, a distance H2 between the flange surface 100*a* of the housing 100 and the center part 101*c* of the surface of the fixed end plate 101*b* is measured.

In addition, the orbiting scroll member 102 has already been fixed on the front case 105. While this state is maintained, a distance H1 between the flange surface 105*a* of the front case 105 and the low top edge 102*f* of the spiral wall body 102*b* of the orbiting scroll member 102 is measured.

Here, in order to achieve the desired distance (tip clearance δ2 explained below), a shim (not shown in FIG. 1)

having a thickness of S satisfying the relation H2+S−H1=δ2 is selected, and the shim is inserted between the flange surface 100*a* of the housing 100 and the flange surface 105*a* of the front case 105.

Figure 3A:
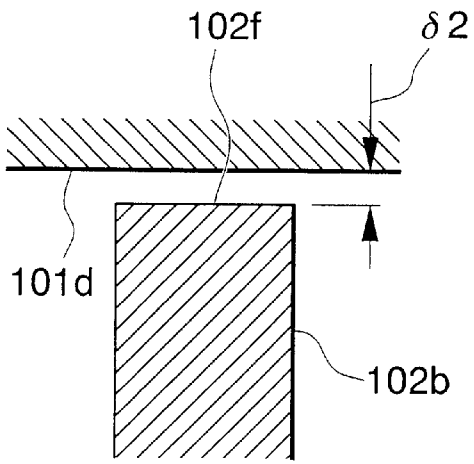
FIG. 3A is a partial enlarged view showing the part denoted by A in FIG. 2.
Figure 3B:
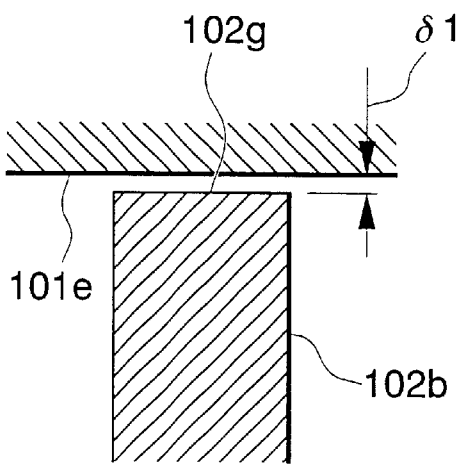
FIG. 3B is a partial enlarged view showing the part denoted by B in FIG. 2.

As shown in FIGS. 3A and 3B, when the tip clearance between the low part 101*e* of the fixed end plate 101*a* and the high top edge 102*g* of the spiral wall body 102*b* corresponding to the low part 101*e* is defined as δ1, and the tip clearance between the high part 101*d* of the fixed end plate 101*a* and the low top edge 102*f* of the spiral wall body 102*b* corresponding to the high part 101*d* is defined as δ2, in the scroll compressor of this embodiment, the relation δ1<δ2 is established. Specifically, in the scroll compressor of this embodiment, δ1 is in a range from 30 to 50 μm, and δ2 is in a range from 60 to 70 μm.

In order to adjust δ1 and δ2 so as to satisfy this relation, the fixed and orbiting scroll members 101 and 102 are designed so as to maintain the relation δ1<δ2. However, since the fixed and orbiting scroll members 101 and 102 have an assemble allowable error, when the fixed and orbiting scroll members 101 and 102 are assembled, all of the fixed and orbiting scroll members 101 and 102 may not satisfy the relation δ1<δ2. Therefore, during assembling, the position of the fixed and orbiting scroll members 101 and 102 are adjusted so as to maintain δ2. Thereby, it is possible to assemble the scroll compressor so as to maintain the relation δ1<δ2.

Similarly, when the tip clearance between the low part 102*e* of the orbiting end plate 102*a* and the high top edge 101*g* of the spiral wall body 101*b* corresponding to the low part 102*e* is defined as δ1, and the tip clearance between the high part 102*d* of the orbiting end plate 102*a* and the low top edge 101*f* of the spiral wall body 101*b* corresponding to the high part 102*d* is defined as δ2, in the scroll compressor of this embodiment, the relation δ1<δ2 is established. Specifically, in the scroll compressor of this embodiment, δ1 is in a range from 40 to 60 μm, and δ2 is in a range from 70 to 80 μm.

The temperature and the pressure of the compressed gas reach a maximum level at the center of the spiral wall bodies 101*b* and 102*b*. Thereby, due to the compressed gas which is at a high temperature and a high pressure, in particular, the spiral wall bodies 101*b* and 102*b* expand at the center thereof. δ2 is set such that when the spiral wall bodies 101*b* and 102*b* expand at the centers thereof, δ2 is a minimum, but is not 0. In contrast, the temperature and the pressure of the compressed gas are relatively low at the outer end of the spiral wall bodies 101*b* and 102*b*. However, the expansion of the spiral wall bodies 101*b* and 102*b* is taken into consideration, and δ1 is set such that when the spiral wall bodies 101*b* and 102*b* expand at the outer ends thereof, δ1 is a minimum, but is not 0. As a result of this setting of δ1 and δ2, δ1 and δ2 are substantially equal and at a minimum, but are not 0 during operation. Thereby, it is possible to prevent the compressed gas from leaking, and to improve the refrigerating ability of the scroll compressor.

Second Embodiment

In the scroll compressor of this embodiment, on the top edges of the spiral wall bodies 101*b* and 102*b*, that is, on the low top edge 101*f* and the high top edge 101*g* of the spiral wall body 101*b* and the low top edge 102*f* and the high top edge 102*g* of the spiral wall body 102*b*, grooves are formed, and tip seals for sealing the border between the top edges of the spiral wall bodies 101*b* and 102*b* and the end plates 101*a* and 102*a* which are opposite the spiral wall bodies 101*b* and 102*b* are fit into the grooves. The tip seal of the scroll compressor of this embodiment has a distinctive size, and distinctive grooves are formed on the high top edges 101*g* and 102*g* which are the outer ends of the spiral wall bodies 101*b* and 102*b*.

Figure 3C:
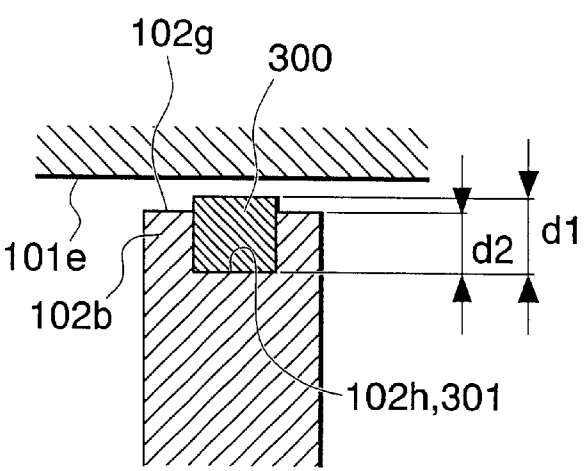
FIG. 3C is a partial enlarged view showing the part denoted by A in FIG. 2 for the case when a tip seal is attached.
Figure 4A:
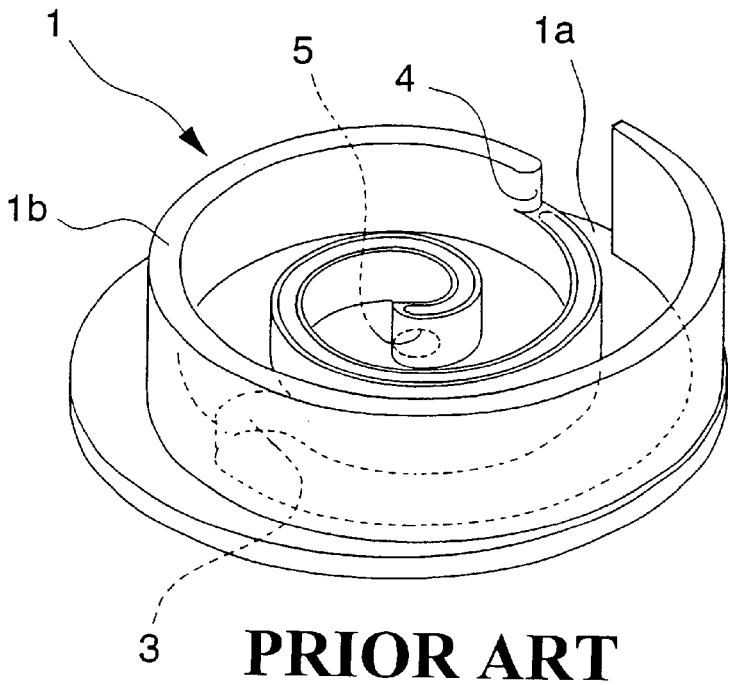
FIG. 4A is a perspective view of a fixed scroll provided in a conventional scroll compressor.
Figure 4B:
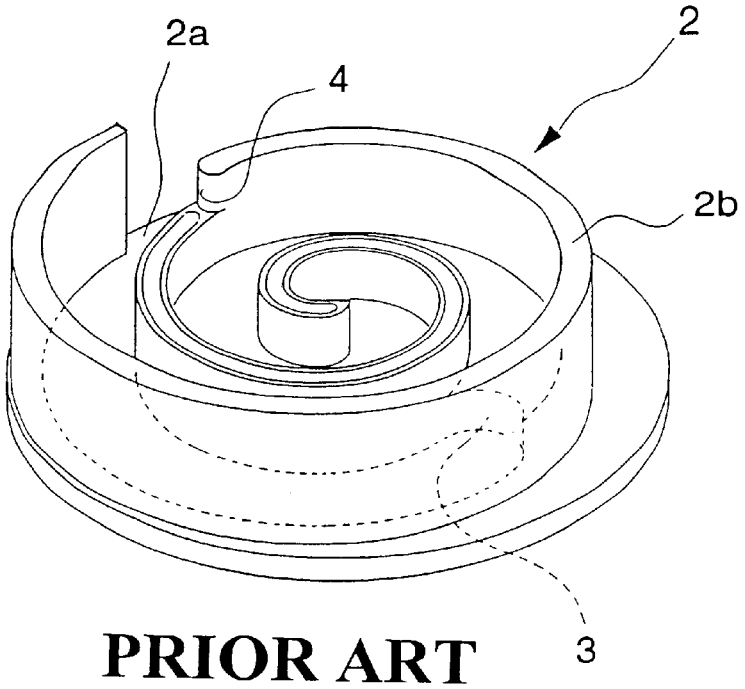
PRIOR ART Fig. 4B
FIG. 4B is a perspective view of an orbiting scroll provided in a conventional scroll compressor.
Figure 5:
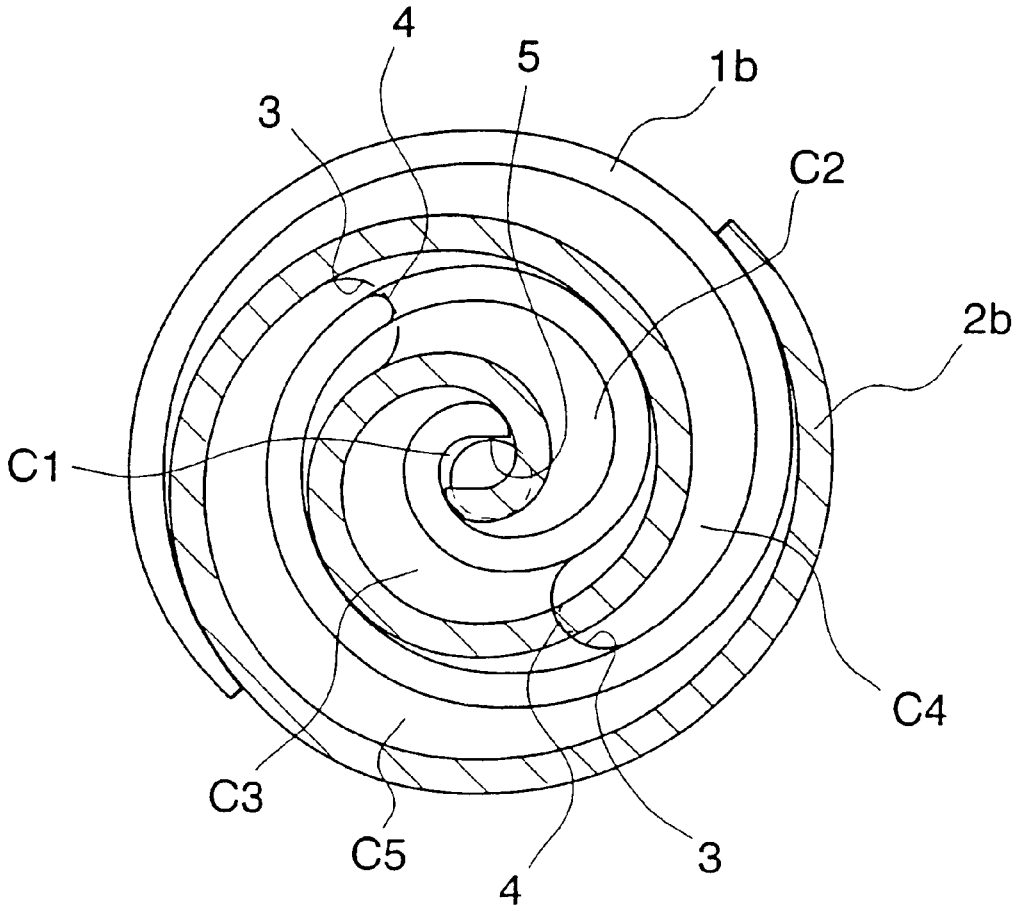
FIG. 5 shows the state in which the fixed scroll and the orbiting scroll of FIGS. 4A and 4B are engaged for the case when viewed from the axis passing through the center of the spiral wall bodies.

Specifically, as shown in FIG. 3C, a groove 102*h* is formed on the high top edge 102*g* of the spiral wall body 102*b*. In addition, a tip seal 300 is fit into the groove 102*h*. When the depth of the groove 102*h* is defined as d2, and the depth of the tip seal 300 is defined as d1, in the scroll compressor of this embodiment, the relation d1>d2 is established.

When d1 and d2 satisfy this relation, the tip seal 300 provided on the high top edge 102*g* protrudes from the high top edge 102*g* of the spiral wall body 102*b*. The following effects can be obtained from this structure. In general, the high pressure compressed gas near the center of the spiral wall bodies 101*b* and 102*b* enters between the tip seal 300 and the inside surface of the groove 102*h* and reach a gap 301 between the bottom surface of the tip seal 300 and the bottom surface of the groove 102*h*. Then, the compressed gas applies a back pressure to the bottom surface of the tip seal 300 and thereby the tip seal 300 is pressed upward. Then, the tip seal 300 provided on the high top edge 102*g* of the spiral wall body 102*b* contacts the low part 101*e* of the fixed end plate 101*a*, and it seals the border between the high top edge 102*g* and the low part 101*e*. However, in the scroll compressor comprising the stepwise spiral wall bodies, for example, the tip seal 300 provided on the spiral wall body 102*b* of the orbiting scroll member 102 is divided into two parts in which one is provided at the center and the other is provided at the outer end of the spiral wall body 102, with respect to the step portion. Since, the pressure of the working gas in the compression chamber at the outer end of the spiral wall body 102 is lower compared with the pressure of the working gas in the compression chamber at the center of the spiral wall body 102, the back pressure applied to the tip seal 300 which is provided at the outer end of the spiral wall body 102 is also lower. Therefore, the seal ability is improved by making the tip seals 300 protrude from the high top edges 101*g* and 102*g* which are the outer end of the spiral wall bodies 101*b* and 102*b* in advance, and the refrigerating ability of the scroll compressor is improved. Moreover, in this embodiment, the protruding distance (d1−d2) is preferably 20 μm, which is smaller than δ1 of the first embodiment.

What is claimed is:

1. A scroll compressor comprising:

a fixed scroll member fixed in position and having a spiral wall body provided on one surface of an end plate;

an orbiting scroll member having a spiral wall body provided on one surface of an end plate, the orbiting scroll member supported by engaging the spiral wall bodies so as to orbit and revolve around the fixed scroll member without rotation;

the spiral wall bodies of the fixed scroll member and the orbiting scroll member each comprise a step portion which divides a top edge of the respective spiral wall body into plural parts forming a low top edge at the center and a high top edge at the outer end of the spiral wall body; and the end plates of the fixed scroll member and the orbiting scroll member each comprise a step portion which divides the respective end plate into a high part at the center and a low part at the outer end of the end plate;

wherein at least one of a clearance between the high part of the end plate of the fixed scroll member and the low top edge of the spiral wall body of the orbiting scroll member, and a clearance between the high part of the end plate of the orbiting scroll member and the low top edge of the spiral wall body of the fixed scroll member is a fixed value, and wherein grooves having a depth are formed on the top edges of the spiral wall bodies, first and second tip seals having a depth and adapted to seal borders between the top edges of the spiral wall bodies and the end plates which are opposite the spiral wall bodies are fit into the grooves, and at least one of the first tip seal which is fit into the groove on the high top edge of the spiral wall body of the orbiting scroll member corresponding to the low part of the end plate of the fixed scroll member, and the second tip seal which is fit into the groove on the high top edge of the spiral wall body of the fixed scroll member corresponding to the low part of the end plate of the orbiting scroll member, protrudes from the high top edge of the respective spiral body, the depths of the first and second tip seals are greater than the depth of the corresponding groove.

2. A scroll compressor according to claim 1, wherein when a tip clearance between the low part of the end plates and the high top edge of the spiral wall bodies corresponding to the low part of the end plates is defined as $\delta 1$, and when a tip clearance between the high part of the end plates and the low top edge of the spiral wall bodies corresponding to the high part of the end plates is defined as $\delta 2$, the relation $\delta 1 < \delta 2$ is established.

3. A scroll compressor according to claim 2, wherein $(\delta 2 - \delta 1)$ is between about 10 $\mu$m and about 40 $\mu$m.

* * * * *